US006856079B1

(12) United States Patent
Zhu

(10) Patent No.: US 6,856,079 B1
(45) Date of Patent: Feb. 15, 2005

(54) CERAMIC DISCHARGE LAMP ARC TUBE SEAL

(75) Inventor: Huiling Zhu, Lexington, MA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/674,707

(22) Filed: Sep. 30, 2003

(51) Int. Cl.[7] ..... H01J 5/50
(52) U.S. Cl. ..... 313/326; 313/332; 313/623
(58) Field of Search ..... 313/326, 332, 313/331, 623

(56) References Cited

U.S. PATENT DOCUMENTS 4,409,517 A * 10/1983 Van Der Sande et al. .. 313/631
5,424,609 A * 6/1995 Geven et al. ..... 313/623
5,455,480 A 10/1995 Bastian et al.
6,075,314 A 6/2000 Huettinger et al.
6,181,065 B1 1/2001 Huettinger et al.
6,392,345 B1 5/2002 Niimi et al.
6,414,451 B1 7/2002 Baake et al.
6,495,959 B1 12/2002 Ikeuchi et al.
6,495,960 B1 12/2002 Takeji et al.

* cited by examiner

*Primary Examiner*—David Vu
(74) *Attorney, Agent, or Firm*—Kinney & Lange, P.A.

(57) ABSTRACT

An arc discharge metal halide lamp having a discharge chamber with visible light permeable walls bounding a discharge region through which walls a pair of electrode assemblies are supported with interior ends thereof positioned in the discharge region spaced apart from one another. These electrode assemblies each also extend through a corresponding capillary tube affixed to the walls to have exterior ends thereof positioned outside the arc discharge chamber. At least one of these electrode assemblies comprises an electrode discharge structure with a discharge region shaft extending into the capillary tube corresponding thereto. A helical coil positioned in part about the discharge region shaft extends outwardly in that corresponding capillary tube to be in direct contact with an interconnection shaft extending outside of that corresponding capillary tube to provide an exterior end of this electrode assembly.

17 Claims, 7 Drawing Sheets

CERAMIC DISCHARGE LAMP ARC TUBE SEAL

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting. Such lamps are well known and include a light transmissive arc discharge chamber sealed about an enclosed a pair of spaced apart electrodes, and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber bounding a discharge region that usually contains quantities of metal halides such as $CeI_3$ and NaI, (or $PrI_3$ and NaI) and TlI, as well as mercury to provide an adequate voltage drop or loading between the electrodes, and also an inert ionization starting gas. A pair of electrodes is arranged on opposite ends of the discharge tube extending from outside the tube into the discharge region to allow electrical energization to occur in that region. Such lamps can have an efficacy as high as 145LPW at 250W with a Color Rendering Index (CRI) higher than 60, and with a Correlated Color Temperature (CCT) between 3000K and 6000K at 250W.

Referring to FIG. 1 in describing such a lamp in more detail, a typical arc discharge metal halide lamp, 10, known in the prior art is shown in a side view having a bulbous, transparent borosilicate glass envelope, 11, fitted into a conventional Edison-type metal base, 12. Lead-in, or electrical access, electrode wires, 14 and 15, of nickel or soft steel, each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11 with access wire 15 extending after some bending into a borosilicate glass dimple, 16', at the opposite end of envelope 11. Electrical access wire 14 is provided with a second section in the interior of envelope 11, extending at an angle to the first section that parallels the envelope length axis, by having this second section welded at such an angle to the first section so that it ends after more or less crossing the envelope length axis.

Some remaining portion of access wire 15 in the interior of envelope 11 is bent at an obtuse angle away from the initial direction thereof parallel to the envelope length axis. Access wire 15 with this first bend therein past flare 16 directing it away from the envelope length axis, is bent again to have the next portion thereof extend substantially parallel that axis, and further along bent again at a right angle to have the succeeding portion thereof extend substantially perpendicular to, and more or less cross that axis near the other end of envelope 11 opposite that end thereof fitted into base 12. The succeeding portion of wire 15 parallel to the envelope length axis supports a conventional getter, 19, to capture gaseous impurities. Three additional right angle bends are provided further along in wire 15 to thereby place a short remaining end portion of that wire below and parallel to the portion thereof originally described as crossing the envelope length axis which short end portion is finally anchored at this far end of envelope 11 from base 12 in glass dimple 16'.

A ceramic arc discharge chamber, 20, configured about a bounded or contained region as a shell structure having polycrystalline alumina walls that are translucent to visible light, is shown in one of various possible geometric configurations in FIG. 1. Alternatively, the walls of arc discharge chamber 20 could be formed of aluminum nitride, yttria ($Y_2O_3$), sapphire ($Al_2O_3$), or some combinations thereof. Discharge chamber 20 is provided in the interior of envelope 11 which interior can otherwise either be evacuated, to thereby reduce the heat transmitted to the envelope from the chamber, or can instead be provided with an inert gaseous atmosphere such as nitrogen at a pressure greater than 300 Torr to thereby increase that heat transmission if operating the chamber at a lower temperature is desired. The region enclosed in arc discharge chamber 20 contains various ionizable materials, including metal halides and mercury which emit light during lamp operation and a starting gas such as the noble gases argon (Ar), xenon (Xe) or neon (Ne).

In this structure for arc discharge chamber 20, as better seen in the cross section view thereof in FIG. 2, a pair of polycrystalline alumina, relatively small inner and outer diameter truncated cylindrical shell portions, or capillary tubes, 21*a* and 21*b*, are each concentrically joined to a corresponding one of a pair of polycrystalline alumina end closing disks, 22*a* and 22*b*, about a centered hole therethrough so that an open passageway extends through each capillary tube and through the hole in the disk to which it is joined. These end closing disks are each joined to a corresponding end of a polycrystalline alumina tube, 25, formed as a relatively large diameter truncated cylindrical shell with that diameter designated as D, so as together to be about the enclosed region in providing the primary arc discharge chamber. The total length of the enclosed space in chamber 20 extends between the junctures of tubes 21*a* and 21*b* with the corresponding one of closing end disks 22*a* and 22*b*. The length of primary central portion chamber structure 25 of chamber 20 extends between the junctures therewith and each of closing end disks 22*a* and 22*b*. These various portions of arc discharge tube 20 are formed by compacting alumina powder into the desired shape followed by sintering the resulting compact to thereby provide the preformed portions, and the various preformed portions are joined together by sintering to result in a preformed single body of the desired dimensions having walls impervious to the flow of gases.

Chamber electrode interconnection wires, 26*a* and 26*b*, of niobium each extend out of a corresponding one of tubes 21*a* and 21*b* to reach and be attached by welding to, respectively, access wire 14 at its end portion crossing the envelope length axis and to access wire 15 at its portion first described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 shows the discharge region contained within the bounding walls of arc discharge chamber 20 that are provided by structure 25, disks 22*a* and 22*b*, and tubes 21*a* and 21*b* of FIGS. 1 and 2, and FIG. 3 shows in cross section view the electrode arrangement having capillary tube 21*a* and the corresponding electrode extending therethrough into the discharge region in greater detail. Chamber electrode interconnection wire 26*a*, being of niobium, has a thermal expansion characteristic that relatively closely matches that of tube 21*a* and that of a glass frit, 27*a*, affixing wire 26*a* to the inner surface of tube 21*a* (and hermetically sealing that interconnection wire opening with wire 26*a* passing therethrough) but cannot withstand the resulting chemical attack resulting from the forming of a plasma in the main volume of chamber 20 during operation. Thus, a molybdenum lead-through wire, 29*a*, which can withstand operation in the plasma, is connected to one end of interconnection wire 26*a* by welding where this end is also surrounded by a portion of frit 27*a* in a hermetic seal, and the other end of lead-through-wire 29*a* is connected to one end of a tungsten main electrode shaft, 31*a*, by welding.

In addition, a tungsten electrode coil, 32*a*, is integrated and mounted to the tip portion of the other end of first main electrode shaft 31*a* by welding, so that an electrode, 33*a*, is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a* serves to dispose electrode 33*a* at a predetermined position in the region contained in the main volume of arc discharge chamber 20. This configuration results in lower temperatures in the sealing regions in capillary tube 21*a* during lamp operation electrode since 33*a*, in extending through this capillary tube into the chamber discharge region a significant distance, thereby spaces it, and the discharge arc established between this and the opposite end electrode during operation, further from the seal region in capillary tube 21*a*.

Lead-through wire 29*a* and a portion of first main electrode shaft 31*a* are spaced from tube 21*a* by a molybdenum coil, 34*a*, having one end thereof in frit 27*a*. Since tungsten rod 31*a* with electrode coil 32*a* mounted thereon to form electrode 33*a* must be placed in the corresponding end of capillary tube 21*a* and then positioned to extend into the discharge region in arc discharge chamber 20*a* selected distance after the fabrication of that chamber has been completed, the inner diameter of capillary tube 21*a* and closing end disk 22*a* must have inner diameters exceeding the outer diameter of the electrode coil 32*a*. As a result, there is a substantial annular space between the outer surface of tungsten rod 31*a* and the inner surfaces of capillary tube 21*a* which must be taken up in part by the provision of molybdenum coil 34*a* around and against the corresponding portion of tungsten rod 31*a*, and which also extends to be around and against rod 26*a*, to complete the interconnections thereof and reduce the condensation in these regions of the metal halide salts occurring in chamber 20 during lamp operation. A typical diameter of interconnection wire 26*a* is 0.9 mm, and a typical diameter of electrode shaft 31*a* is 0.5 mm.

Similarly, in FIG. 2, chamber electrode interconnection wire 26*b* is affixed by a glass frit, 27*b*, to the inner surface of tube 21*b* (and hermetically sealing that interconnection wire opening with wire 26*b* passing therethrough). A molybdenum lead-through wire, 29*b*, is connected to one end of interconnection wire 26*b* by welding where this end is also surrounded by a portion of frit 27*b* in a hermetic seal, and the other end of lead-through wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that an electrode, 33*b*, is configured by main electrode shaft 31*b* and electrode coil 32*b* which is disposed at a predetermined position in the discharge region of chamber 20 to thereby provide sufficiently lower temperatures in the corresponding seal region. Lead-through wire 29*b* and a portion of second main electrode shaft 31*b* are spaced from tube 21*b* by a molybdenum coil, 34*b*, to fill in part the resulting annular space therebetween needed to allow electrode 33*b* to pass, the outer end of that coil also being in frit 27*b*. A typical diameter of interconnection wire 26*b* is also 0.9 mm, and a typical diameter of electrode shaft 31 is again 0.5 mm.

These electrode arrangements have "compromise" properties components in the seal regions within capillary tubes 21*a* and 21*b*, these being outer electrode portion niobium rods 26*a* and 26*b* which provide very good thermal expansion matching to the polycrystalline alumina but which are also subject to chemical attack during lamp operation by the metal halides within arc discharge tube 20. The exposure length of each of these outer electrode portions within arc discharge chamber 20 must be limited thus requiring the presence of the bridging middle part of the electrode arrangement, usually a molybdenum rod as above or a cermet rod, between such outer electrode portion and the corresponding tungsten electrode portion.

Care must also taken to ensure that the melted sealing frits 27*a* and 27*b* flow completely around and beyond the corresponding niobium rods to thereby form a protective surface over the niobium against the chemical reactions due to the halides. The frit flow length inside the corresponding capillary tube needs to be controlled very precisely. If the frit length is short, the niobium rod portion of the electrode is exposed to chemical attack by the halides. If this length is excessive, the large thermal mismatch between the frit and the solid middle electrode portion molybdenum, tungsten or cermet rod following inward from the niobium rod leads to cracks in the sealing frit or polycrystalline alumina, or both, in that location. Furthermore, although frits 27*a* and 27*b* are relatively resistant to halide attack during lamp operation, these sealing frits are not impervious to chemical attacks.

In these circumstances, of course, other ceramic arc discharge chamber constructions for ceramic metal halide lamps that make use of different sealing methods have been resorted to. These include methods such as direct sintering of polycrystalline alumina to the electrode arrangement, the use of cermets and grade temperature coefficient of expansion seals, or even the use of new arc tube materials that enable straight sealing of the tube body to a single material electrode such as molybdenum or tungsten. There have been occasional introduction of lamps that used a cermet to replace niobium.

However, these alternative methods have not yet been able to demonstrate an overall advantage with respect to improved lamp performance, lower cost, or compatibility with existing lamp factory processes. Thus, there is a desire to substitute some other material for niobium at the seal location so that arc discharge chamber electrode fabrication and the subsequent sealing process used therewith can be simplified and made more resistant to halide based chemical corrosion during lamp operation, and also allow a minimum and non-critical exposure length for the sealing frit used within the electrode capillary tubes.

BRIEF SUMMARY OF THE INVENTION

The present invention provides an arc discharge metal halide lamp for use in selected lighting fixtures having a discharge chamber with visible light permeable walls bounding a discharge region through which walls a pair of electrode assemblies are supported with interior ends thereof positioned in the discharge region spaced apart from one another. These electrode assemblies each also extend through a corresponding capillary tube affixed to the walls to have exterior ends thereof positioned outside the arc discharge chamber. At least one of these electrode assemblies comprises an electrode discharge structure located at the interior end thereof, the electrode discharge structure having a discharge region shaft extending into the capillary tube corresponding thereto. A helical coil positioned in part about the discharge region shaft in the corresponding capillary tube also extends outwardly in that corresponding capillary tube to be in direct contact with an interconnection shaft extending outside of that corresponding capillary tube to provide the exterior end of this electrode assembly. Such an arrangement can also be provided for the other electrode assembly.

The interconnection shaft is sealed in the corresponding capillary tube with a sealing frit with this shaft either having the other end of the helical coil wound thereabout or being provided by an extended end of the helical coil. A spatial volume occupying structure can be used to reduce the amount needed of such frit.

DETAILED DESCRIPTION

Forming a reliable seal about the electrically conductive lead portion of an arc discharge chamber electrode that extends from the electrode portion positioned within the discharge chamber through the corresponding capillary tube to provide a conductive portion outside that tube requires some thermal expansions compatibility between the various portions of the electrode and the chamber involved. The polycrystalline alumina material of the arc discharge chamber and capillary tube affixed thereto, the metal materials of the electrically conductive lead portion, and the sealing frit materials in the electrode lead structure arrangement have to have similar thermal expansion coefficients to reduce the stresses in the sealing region that each can impose on the others during operation of the lamp.

In addition, the selection of suitable geometries, and locations, for the components of such electrode lead structure arrangements can significantly further reduce the thermal stresses present. Thus, the use of a thin, and typically flexible, structure for the electrically conductive lead portion of an arc discharge chamber electrode such as a thin metal wire therefor results in significantly lower thermal stress thereabout over temperature changes. This is because such a thin wire can more easily yield slightly, including both elastic and thermoplastic deformations thereof, to thereby reduce stress values in the adjacent sealing frit below those that would otherwise occur. Further, the metal wire for the electrically conductive lead portion of an arc discharge chamber electrode can be configured to follow the shape of a helical path over some portion of its extent to thereby significantly increase the length of the path followed by the wire and the amount of the surface of the wire that the frit seals against which further reduces chances of leaks out of the end of the capillary tube due to separations occurring between the wire and the frit during use of the lamp.

The foregoing structures for the metal lead wire in the sealing region in the capillary tube serving as the electrically conductive lead portion of an arc discharge chamber electrode can be accomplished using only molybdenum material for the wire. The result of forming that wire without niobium will eliminate the possibility of chemical reaction between such niobium material had it been used and metal halide constituents occurring in the chamber discharge region during lamp operation. Another advantage of using only molybdenum material is that a single molybdenum wire forms the electrically conductive lead portion of an arc discharge chamber electrode through the sealing region down to the weld thereof with the tungsten electrode portion positioned in and adjacent to the discharge chamber without any intervening welds which results in higher electrode integrity reliability and lower fabrication cost.

Figure 1:
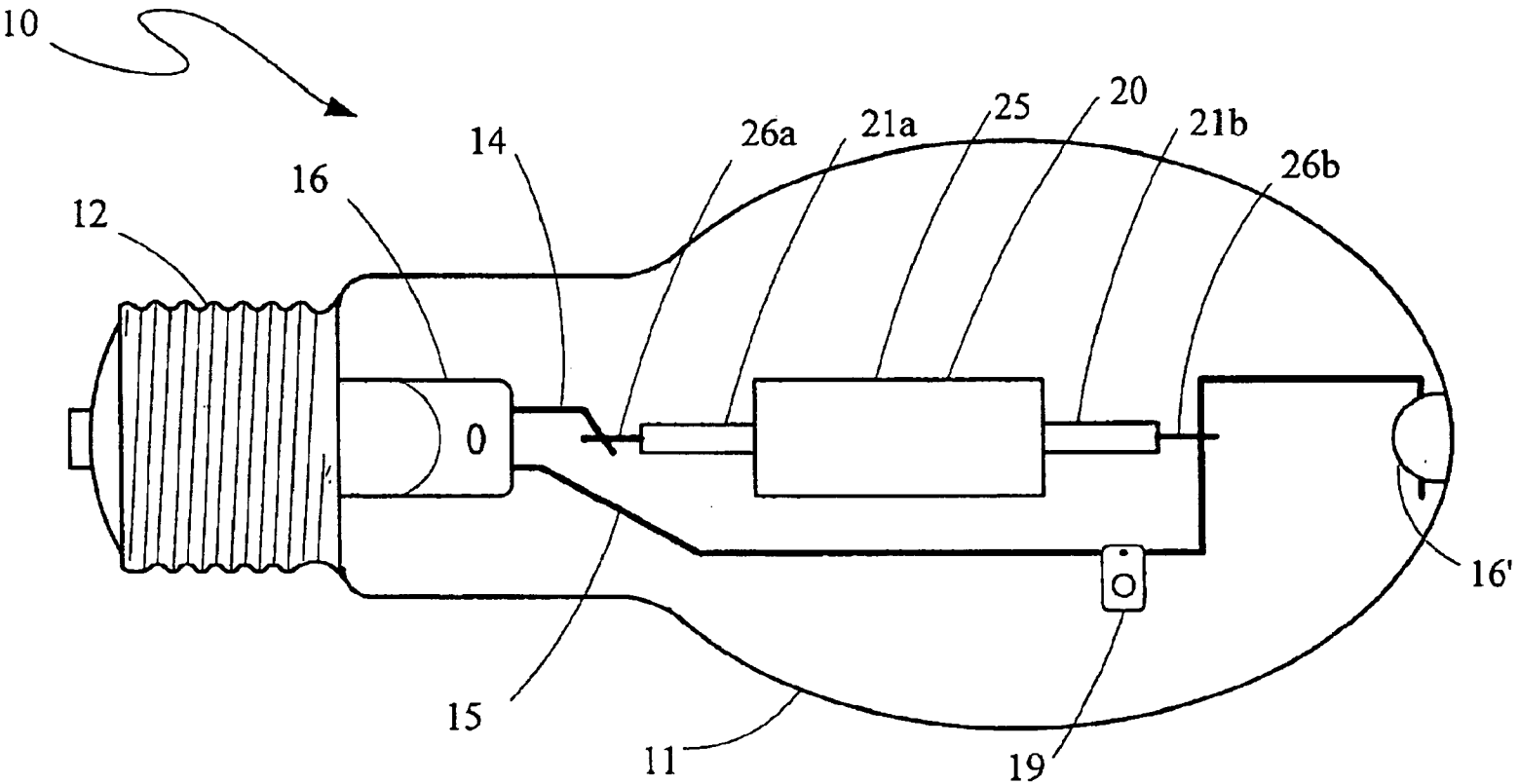
FIG. 1 is a side view, partially in cross section, of an arc discharge metal halide lamp of the present invention having a ceramic arc discharge chamber of a selected configuration therein.
Figure 2:
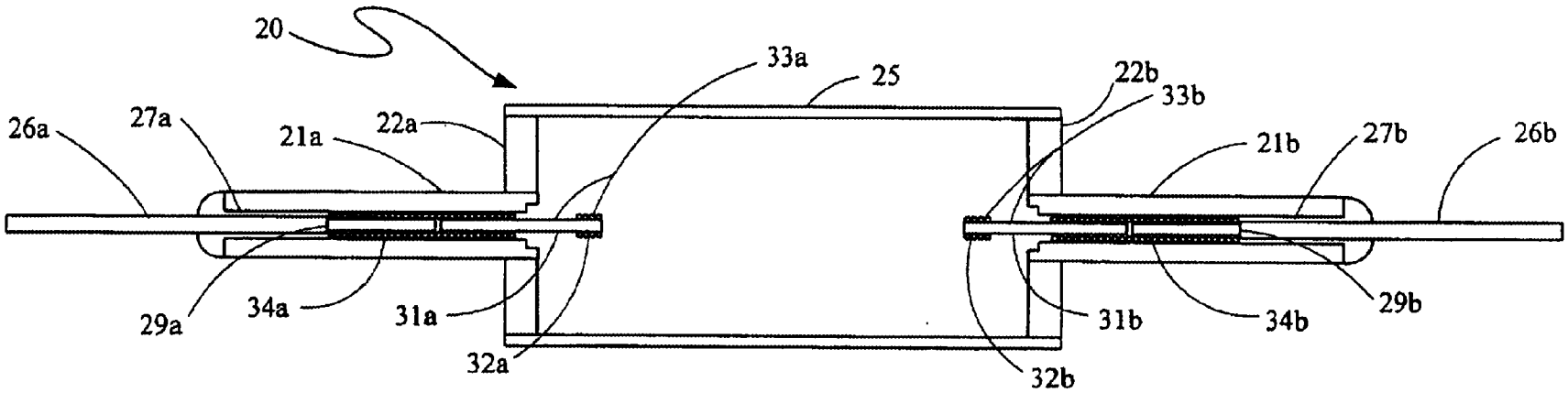
Fig. 2 PRIOR ART
FIG. 2 shows a known arc discharge chamber for the arc discharge chamber of FIG. 1 in cross section in an expanded view.
Figure 3:
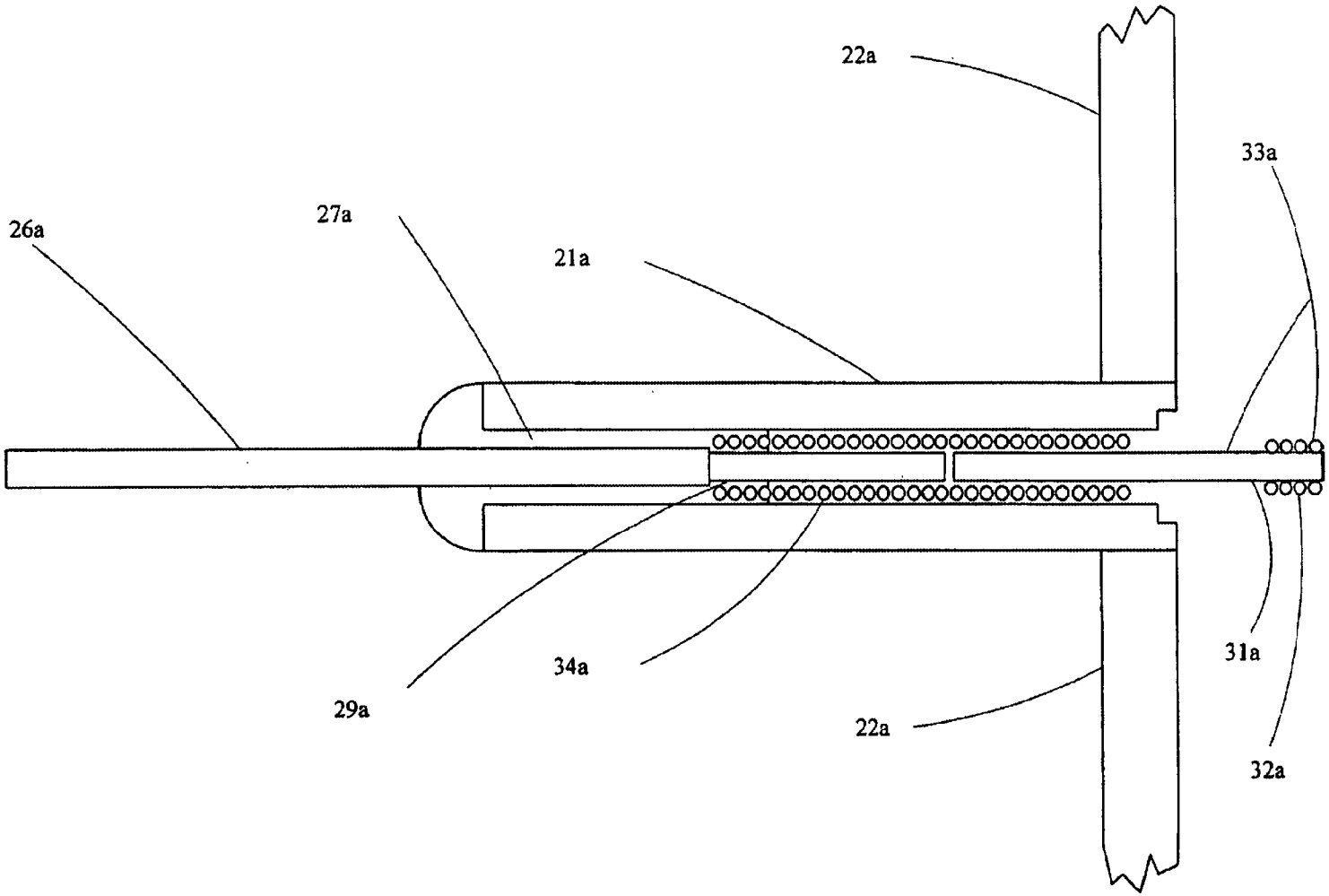
Fig. 3 PRIOR ART
FIG. 3 shows a portion of the arc discharge chamber of FIG. 2 in cross section in an expanded view.
Figure 4:
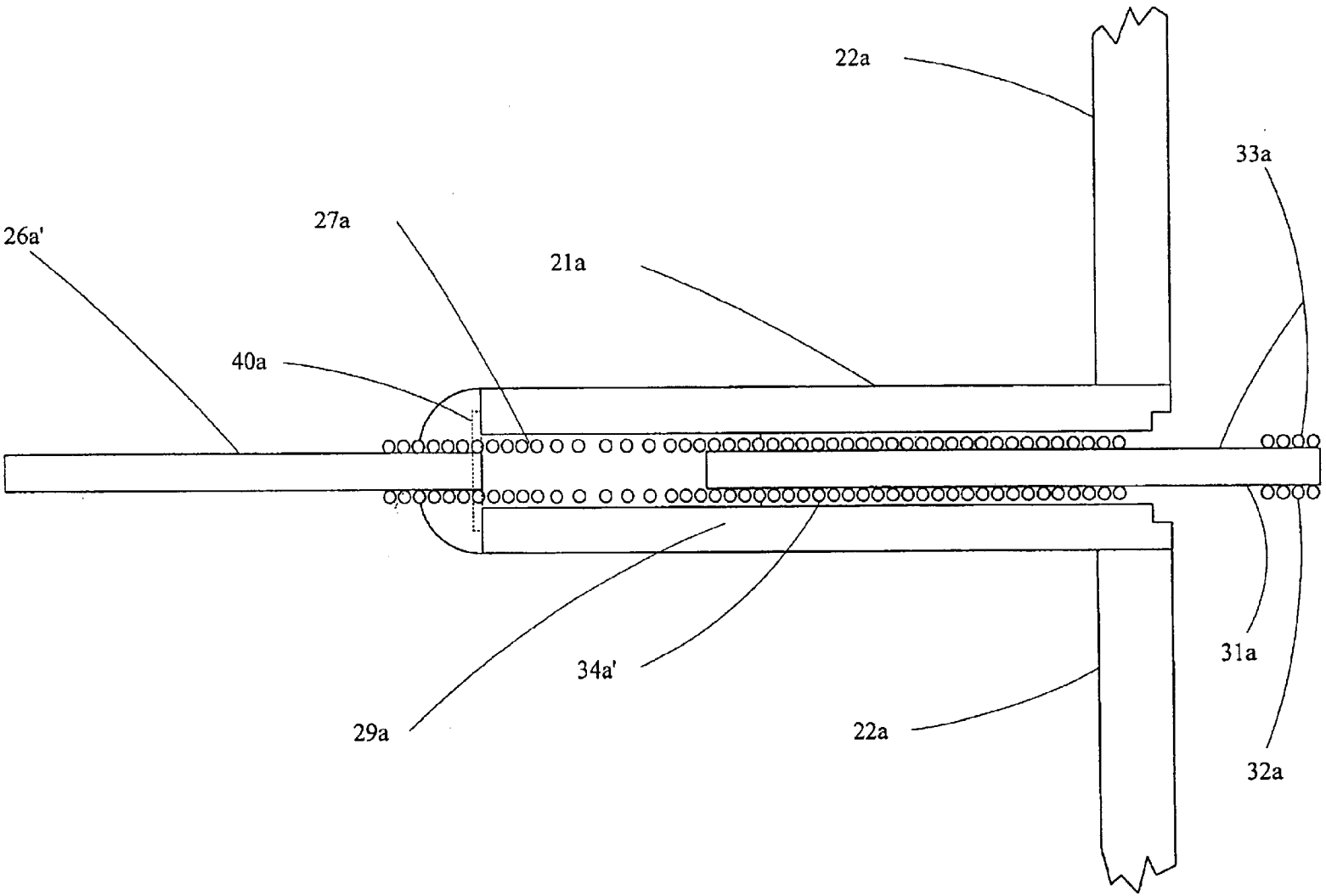
FIG. 4 shows a portion of an arc discharge chamber in cross section with an embodiment of the present invention.

An implementation of such an electrode arrangement is shown in the cross section view thereof in FIG. 4. There, a molybdenum coil, 34*a*', is shown winding about and against tungsten rod 31*a* in a helical coil having adjacent coil loops in, or nearly in, contact with one another, and thereafter stretched outward in the sealing region containing frit 27*a* to form a helical coil there having a greater pitch (distance from the center of the wire in one coil loop to the center of the wire in an adjacent coil loop). This greater pitch in this portion of the coil can be from 1.1 times to 3 times the diameter of the molybdenum wire used to form this coil which is typically about in the range of 0.05 to 1.0 mm. This helical coil continues and extends outside the end of capillary tube 21*a* at a reduced pitch there to be positioned about and against either a niobium or molybdenum rod, 26*a*', in being in electrical contact with, and effectively attached to, that rod which forms the external electrode interconnection portion. The pitches actually occurring over the length of any particular helical coil used will typically vary as a result of the deformations occurring thereto in the manipulation thereof during the placement and positioning of the electrode in the chamber discharge region in the fabrication process. An optional niobium positioning guide wire, 40*a*, is shown in dashed line form welded near the end of molybdenum coil 34*a*' to limit the length of the electrode portion inserted into capillary tube 21*a* and the chamber discharge region. A sealing frit material is chosen with a thermal expansion coefficient value at the working temperature of discharge chamber 20 during lamp operation that is between the thermal expansion coefficient value of the polycrystalline alumina used in capillary tube 21*a* and the thermal expansion coefficient of the molybdenum used in coil 34*a*' to thereby reduce thermal stresses between that polycrystalline alumina and the coil. A typical frit is formed from $Al_2O_3$ in a proportion of 18 to 20% by weight, $SiO_2$ in a proportion of 20 to 22% by weight and $Dy0_3$ in a proportion of 60 to 63% by weight. Alternatively, oxides of strontium, barium yttrium or calcium can be substituted for either or both of $SiO_2$ and $Dy_2O_3$.

The flexibility resulting from the use of molybdenum helical coil 34*a*' in completing the electrode connection from tungsten rod 31*a* all the way to external electrode interconnection portion 26*a*' outside of capillary tube 21*a* will further reduce thermal stresses between the polycrystalline alumina of capillary tube 21*a* and that coil that still come about to the mismatch of thermal expansion coefficients of each. In addition, the greatly increased length of molybdenum helical coil 34*a*' compared to a straight electrode lead adds considerably to the surface of the coil against which frit 27*a* seals to further reduce chances of arc discharge chamber leaks through capillary tube 21*a* due to any eventual occurrence of a separation between the coil and frit 27*a* during use of the lamp.

Important to maintaining discharge chamber performance during lamp use, frit 27*a* should, during its provision in fabrication to effect a seal, flow in its initial liquid state (liquified by heating) sufficiently inward along the polycrystalline capillary tube 21*a* to cover two to four turns of molybdenum coil 34*a*'over the end of tungsten rod 31*a*. Such coverage by frit 27*a* of the end of tungsten rod 31*a* will prevent helical coil 34*a*' from unwinding during subsequent lamp operations and so assure that the insertion length of tungsten electrode 33*a* into the chamber discharge region will not change during use of the lamp.

Figure 5:
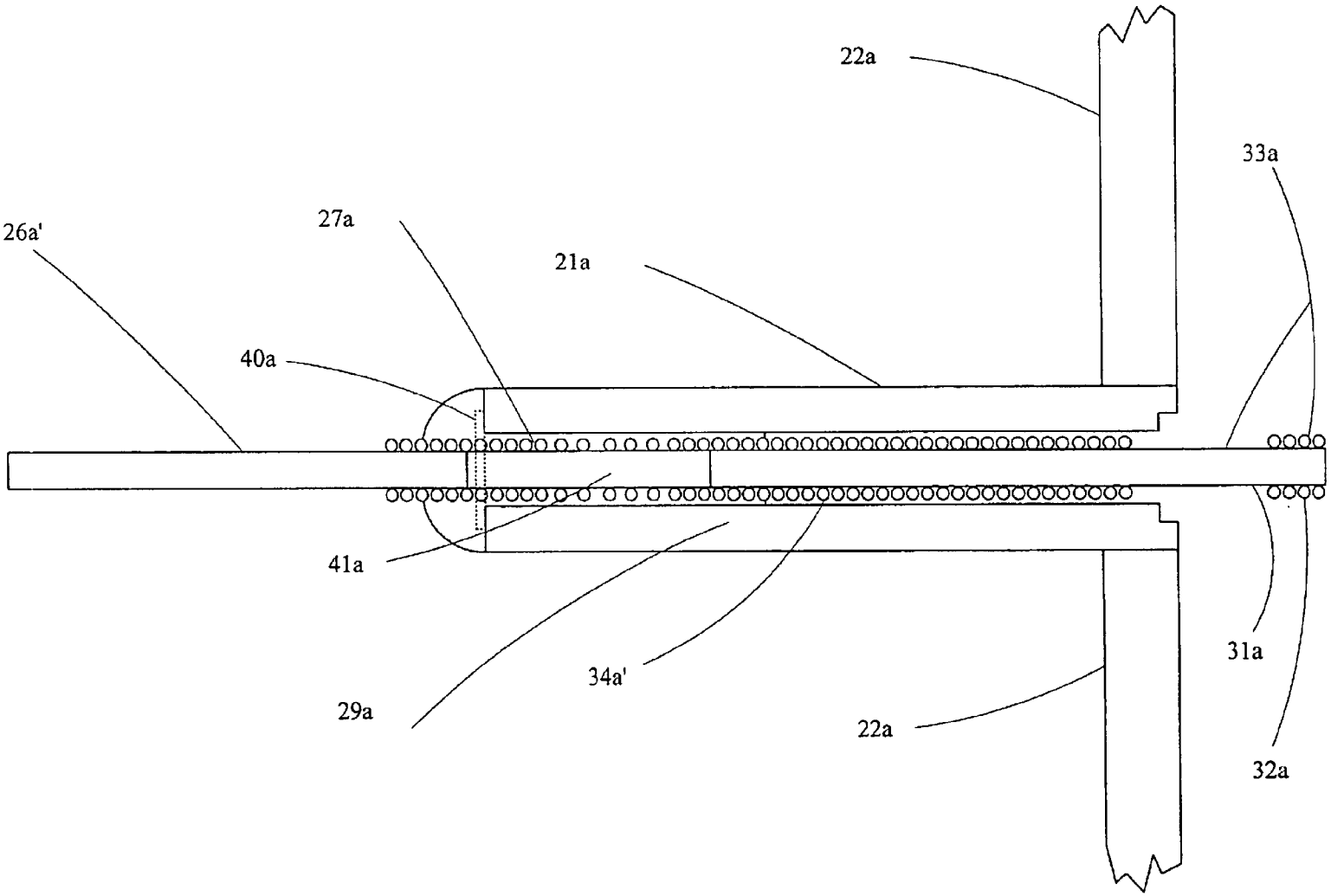
FIG. 5 shows a portion of an arc discharge chamber in cross section with an alternative embodiment of the present invention.

FIG. 5 shows in cross section an alternative embodiment of the electrode arrangement of FIG. 4. In this arrangement, a solid polycrystalline alumina rod, 41*a*, is inserted within the interior space of molybdenum helical coil 34*a*' in the sealing region provided by frit 27*a* in capillary tube 21*a* about that coil to occupy a portion of that volume. Alumina rod 41*a* has a diameter smaller than the inner diameter of coil 34*a*', that is, a diameter between 0.4 to 0.5 mm for the coil provided in an arc discharge chamber used in a 150W lamp. The addition of polycrystalline alumina rod 41*a* reduces the volume of sealing frit 27*a* needed to fill in the open space volume of the sealing region prior to such sealing. If a relatively large volume of sealing frit 27*a* must be present in the sealing region to fill the volume thereof not taken up by coil 34*a*', some voids in the frit in the nature of spherical cavities can form during the sealing process used in sealing capillary tube 21*a* with the electrode structure present therein. Polycrystalline alumina rod 41*a* should not be tightly fitted to the interior sides of molybdenum helical coil 34*a*' to thereby allow frit 27*a* to bond to the coil on all of its surface areas including the surface portions located between the coil and alumina rod 41*a*.

Figure 6:
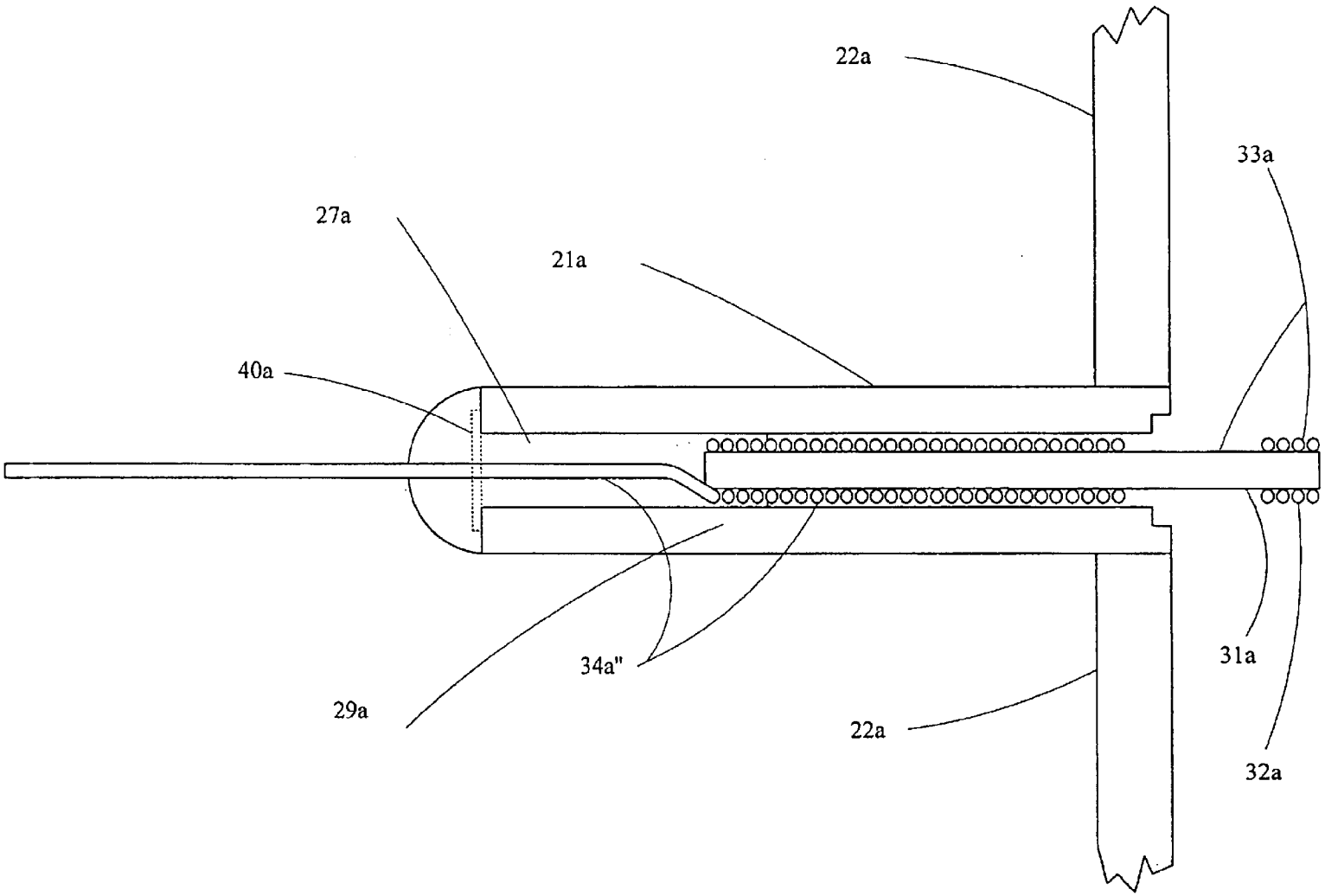
FIG. 6 shows a portion of an arc discharge chamber in cross section with an alternative embodiment of the present invention.

The electrode arrangement of FIG. 4 can be further improved by substituting a different configuration for molybdenum helical coil 34*a*' of that figure which will allow dispensing altogether with external electrode interconnection portion 26'. Thus, FIG. 6 shows in cross section a further alternative embodiment of an electrode arrangement having a thin molybdenum wire, about 0.25 mm in diameter although this diameter can be approximately in the range of 0.05 to 0.40 mm, to form an alternative extended end coil, 34*a*". Coil 34" remains a helical coil with contacting, or nearly contacting, adjacent coil loops where provided about and against tungsten electrode shaft 31*a*. However, coil 34" is provided with an extended end that is a straight, or approximately straight, wire portion past the end of tungsten electrode shaft 31*a* which portion extends through the remainder of capillary tube 21 to a distance beyond the outer end of that tube. Thus, this straight wire portion of extended end coil 34*a*" is what frit 27*a* seals against in the sealing region within capillary tube 21*a*. The part of the straight wire portion of extended end coil 34*a*" that extends past the outer end of capillary tube 21*a* also serves as the external interconnection portion of the electrode arrangement thereby further simplifying the electrode arrangement and lowering the cost of fabricating same. Optional positioning guide wire 40*a*, shown in dashed line form, can again be welded to the straight wire portion of molybdenum extended end coil 34*a*" near its outer end to limit the length of electrode insertion during fabrication. Here, however, the alternative of a very small wire loop in a plane vertical to the straight wire portion axis of extent can be twisted into that otherwise straight portion to form such an insertion distance limiting stop.

Figure 7:
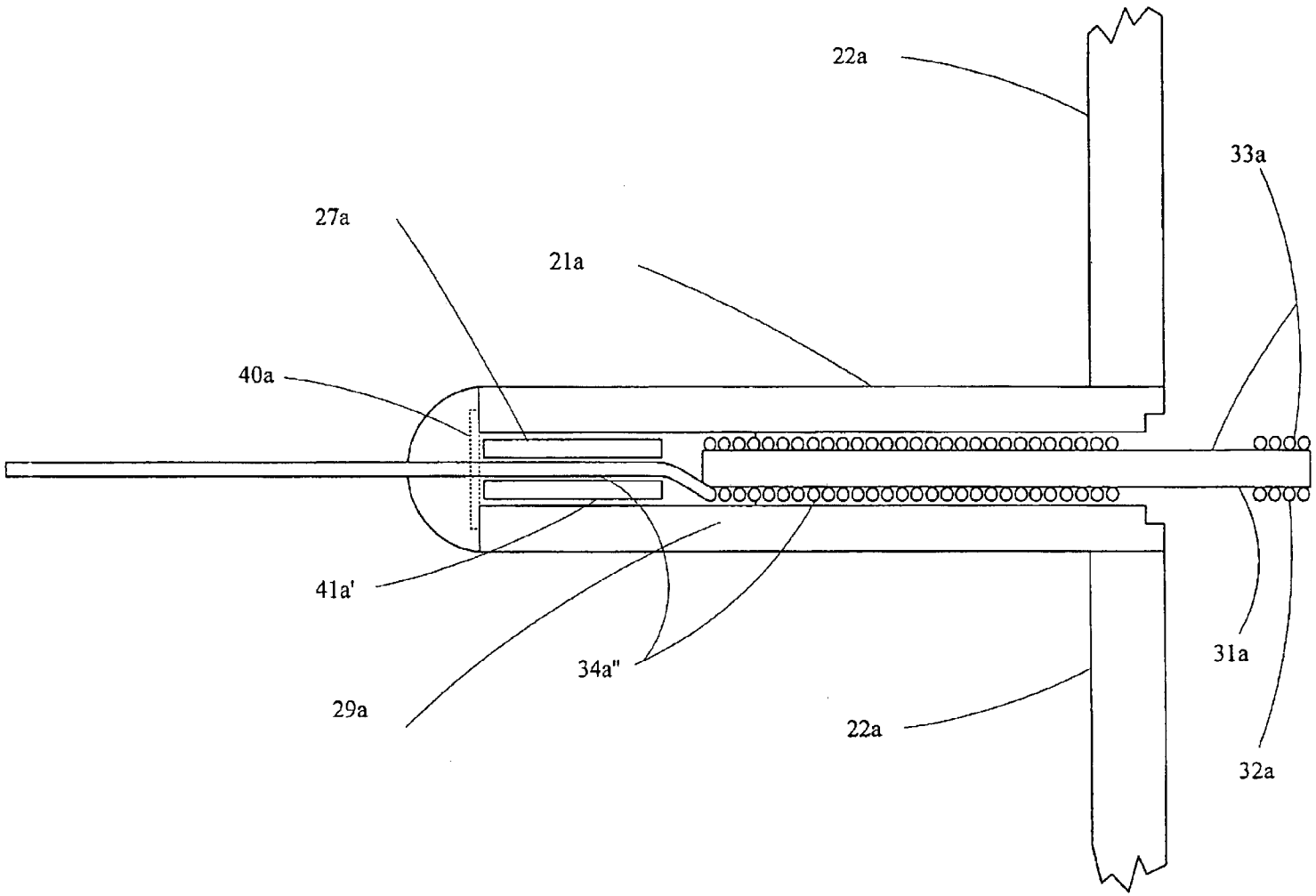
FIG. 7 shows a portion of an arc discharge chamber in cross section with an alternative embodiment of the present invention.

Here, too, a further improvement can be made through reducing the volume of frit 27*a* needed to fill the sealing region volume not taken up by the straight wire portion of extended end coil 34". Thus, FIG. 7 shows in cross section the result of adding a polycrystalline alumina sleeve, 41*a*', about the straight wire portion of molybdenum extended end coil 34*a*" in the sealing region within capillary tube 21*a* to occupy a substantial portion of that volume. If used in an arc discharge chamber suited for a 150W lamp, polycrystalline alumina sleeve 41*a*' has an outer diameter of 1.0 mm, an inner diameter of 0.5 mm, and a length of 3.5 mm. Polycrystalline alumina sleeve 41*a*' will not only reduce the volume of frit 27*a* needed in the sealing region, but its presence also makes the wetting easier by frit 27*a* of the surfaces of the sealing region structures that are adjacent to the gaps to be filled in by the frit.

The electrode arrangement provided in connection with capillary tube 21*b* at the opposite end of arc discharge chamber 20 is generally symmetric with the arrangement provided in connection with capillary tube 21*a* though it not necessarily need be. However, all of the foregoing electrode arrangement embodiments shown provided in connection with capillary tube 21*a* can also be provided in connection with capillary tube 21*b*.

Although the present invention has been described with reference to preferred embodiments, workers skilled in the art will recognize that changes may be made in form and detail without departing from the spirit and scope of the invention.

What is claimed is:

1. An arc discharge metal halide lamp for use in selected lighting fixtures, said lamp comprising:

a discharge chamber having visible light permeable walls of a selected shape bounding a discharge region through which walls a pair of electrode assemblies are supported with interior ends thereof positioned in said discharge region spaced apart from one another, and with said electrode assemblies each also extending through a corresponding capillary tube affixed to said walls to have exterior ends thereof positioned outside said arc discharge chamber; and at least one of said electrode assemblies comprising an electrode discharge structure located at said interior end of that said electrode assembly with said electrode discharge structure having a discharge region shaft extending into said capillary tube corresponding thereto, and further comprising a helical coil positioned in part about said discharge region shaft in said corresponding capillary tube and extending outwardly in said corresponding capillary tube to be in direct contact with an interconnection shaft extending outside of said corresponding capillary tube to provide said exterior end of that said electrode assembly.

2. The lamp of claim 1 further comprising that remaining said electrode assembly having an electrode discharge structure located at said interior end of that remaining said electrode assembly with said electrode discharge structure having a discharge region shaft extending into said capillary tube corresponding thereto, and further comprising a helical coil positioned in part about said discharge region shaft in said corresponding capillary tube and extending outwardly in said corresponding capillary tube to be in direct contact with an interconnection shaft extending outside of said corresponding capillary tube to provide said exterior end of that remaining said electrode assembly.

3. The lamp of claim 1 wherein said helical coil is also positioned in part about said interconnection shaft.

4. The lamp of claim 1 wherein said helical coil is formed as an extended end coil so that an end portion thereof following a geometric curve other than a helix serves as said interconnection shaft.

5. The lamp of claim 1 further comprising a sealing frit positioned between at least a portion of said interconnection shaft and at least a portion of said corresponding capillary tube.

6. The lamp of claim 1 further comprising a spatial volume occupying structure positioned adjacent to said interconnection shaft.

7. The lamp of claim 1 wherein said helical coil is formed of molybdenum.

8. The lamp of claim 3 further comprising a sealing frit positioned between at least a portion of said interconnection shaft and at least a portion of said corresponding capillary tube.

9. The lamp of claim 3 further comprising a spatial volume occupying structure positioned within said helical coil between said interconnection shaft and said electrode shaft.

10. The lamp of claim 4 further comprising a sealing frit positioned between at least a portion of said interconnection shaft and at least a portion of said corresponding capillary tube.

11. The lamp of claim 4 further comprising a spatial volume occupying structure formed as a sleeve positioned about said interconnection shaft to be between said interconnection shaft and said corresponding capillary tube.

12. The lamp of claim 7 wherein said helical coil is formed from molybdenum wire having a diameter between 0.05 mm and 1.0 mm.

13. The lamp of claim 8 wherein said interconnection shaft is substantially positioned outside of said corresponding capillary tube with said helical coil also extending in part outside of said corresponding capillary tube to be about said interconnection shaft, and wherein said sealing frit is provided at least in part outside of, but against, said corresponding capillary tube and about both said interconnection shaft and said helical coil there.

14. The lamp of claim 9 further comprising a sealing frit positioned between at least a portion of said interconnection shaft and at least a portion of said corresponding capillary tube and about at least a portion of said spatial volume occupying structure.

15. The lamp of claim 11 further comprising a sealing frit positioned between at least a portion of said interconnection shaft and at least a portion of said corresponding capillary tube and about at least a portion of said spatial volume occupying structure.

16. The lamp of claim 12 wherein said helical coil is formed from molybdenum wire having a diameter between 0.05 mm and 0.4 mm.

17. The lamp of claim 12 wherein said helical coil follows a path of a variable pitch helix with a portion thereof interior to ends thereof having a pitch greater than that occurring elsewhere therein that is in a range of 1.1 to 3 times said diameter of said molybdenum wire.

* * * * *